US011731247B2

(12) United States Patent
Chen

(10) Patent No.: US 11,731,247 B2
(45) Date of Patent: Aug. 22, 2023

(54) TWO-WAY NUT SPANNER

(71) Applicant: SHIN-YAIN INDUSTRIAL CO., LTD., Taichung (TW)

(72) Inventor: Pen Hung Chen, Taichung (TW)

(73) Assignee: SHIN-YAIN INDUSTRIAL CO., LTD., Taichung (TW)

( * ) Notice: Subject to any disclaimer, the term of this patent is extended or adjusted under 35 U.S.C. 154(b) by 176 days.

(21) Appl. No.: 17/382,331

(22) Filed: Jul. 21, 2021

(65) Prior Publication Data

US 2023/0026890 A1 Jan. 26, 2023

(51) Int. Cl.
*B25B 13/08* (2006.01)
*B25B 23/00* (2006.01)

(52) U.S. Cl.
CPC ..... *B25B 13/08* (2013.01); *B25B 23/0071* (2013.01)

(58) Field of Classification Search
CPC ..... B25B 13/08; B25B 13/48; B25B 13/50; B25B 23/0071; B25B 27/14
See application file for complete search history.

(56) References Cited

U.S. PATENT DOCUMENTS 2,830,480 A * 4/1958 Brame ..... B25B 13/48 81/176.15
6,745,648 B2 * 6/2004 Stier ..... B25B 13/08 81/176.1
7,152,510 B2 * 12/2006 Gerber ..... F16B 23/0061 81/461
9,032,846 B2 * 5/2015 York ..... B25B 13/02 409/234
9,415,487 B2 * 8/2016 Wilson ..... B25B 13/50
10,882,163 B2 * 1/2021 Sweeney ..... B25B 13/50
D912,482 S * 3/2021 Miller ..... B25B 23/0028 D8/21
D913,762 S * 3/2021 Sweeney ..... B25B 13/50 D8/27
11,117,245 B2 * 9/2021 Rodeheaver ..... B25B 13/5091
2012/0125162 A1 * 5/2012 Nguyen ..... B25B 13/08 81/119
2019/0126444 A1 * 5/2019 Rodeheaver ..... B25B 13/50

* cited by examiner

*Primary Examiner* — David B. Thomas
(74) *Attorney, Agent, or Firm* — Hershkovitz & Associates, PLLC; Abe Hershkovitz

(57) ABSTRACT

A two-way nut spanner has a handle and an engaging head having a base, a first engaging portion and a second engaging portion. The base has a first abutting surface and a second abutting surface respectively located on two opposite sides of the base. The first engaging portion protrudes from the first abutting surface of the base and has multiple first engaging blocks. Each of the engaging blocks has a first inclined surface. The second engaging portion protrudes from the second abutting surface of the base and has a second engaging block having a second inclined surface. The engaging head has the first engaging portion and the second engaging portion with different engaging structures to enhance convenience for using the two-way nut spanner.

10 Claims, 12 Drawing Sheets

TWO-WAY NUT SPANNER

BACKGROUND OF THE INVENTION

1. Field of the Invention

The present invention relates to a spanner for a nut, especially to a two-way nut spanner adapted to turn a nut connected on a cutter holder.

2. Description of the Prior Art

A conventional spanner is adapted to turn a nut to fasten or loosen the nut. Because the cutter tool can connect with one of various cutters, e.g. drills, milling cutters, chamfer cutters, and so on, if a cutting head of the cutter is too larger to block a socket type conventional spanner to vertically connect with the nut, a conventional spanner of a different type is used to detach the nut connected on the cutter holder.

In addition, there are various types of nuts, and one of the nuts adapted to connect on the cutter holder has multiple grooves arranged around an external peripheral surface of the nut. Each groove has an inclined groove surface extending obliquely and inwardly from an edge thereof away from an end surface of the nut to the end surface of the nut. Because of the inclined groove surfaces, the conventional spanner cannot stably engage with the grooves of the nut. Consequently, the conventional spanner is easily disengaged from the nut during rotating to turn the nut.

To overcome the shortcomings, the present invention provides a two-way nut spanner to mitigate or obviate the aforementioned problems.

SUMMARY OF THE INVENTION

The main objective of the present invention is to provide a two-way nut spanner that has two types of engaging portions to loosen or fasten a nut having inclined groove surfaces.

The two-way nut spanner in accordance with the present invention comprises a handle and an engaging head formed on an end of the handle and having a central axis, a base, a first engaging portion, and a second engaging portion. The base surrounds the central axis of the engaging head to form a C-shape and has a first abutting surface and a second abutting surface respectively located at two opposite sides of the base. The first engaging portion protrudes from the first abutting surface of the base and has a first surrounding portion and multiple first engaging blocks. The first surrounding portion is C-shaped, protrudes from the first abutting surface of the base, and has a first opening. The first engaging blocks protrude from an inner surface of the first surrounding portion, and are arranged around the central axis of the engaging head at angular intervals. Each of the first engaging blocks has a first inclined surface located away from the first surrounding portion and extending obliquely from the first abutting surface of the base toward the first surrounding portion and away from the first abutting surface of the base.

The second engaging portion protrudes from the second abutting surface of the base and has a second surrounding portion and a second engaging block. The second surrounding portion is C-shaped, protrudes from the second abutting surface, and has a second opening. The second engaging block protrudes from an inner surface of the second surrounding portion, is located near one of two edges of the second opening, and has a second inclined surface located away from the second surrounding portion and extending obliquely from the second abutting surface toward the second surrounding portion and away from the second abutting surface of the base.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
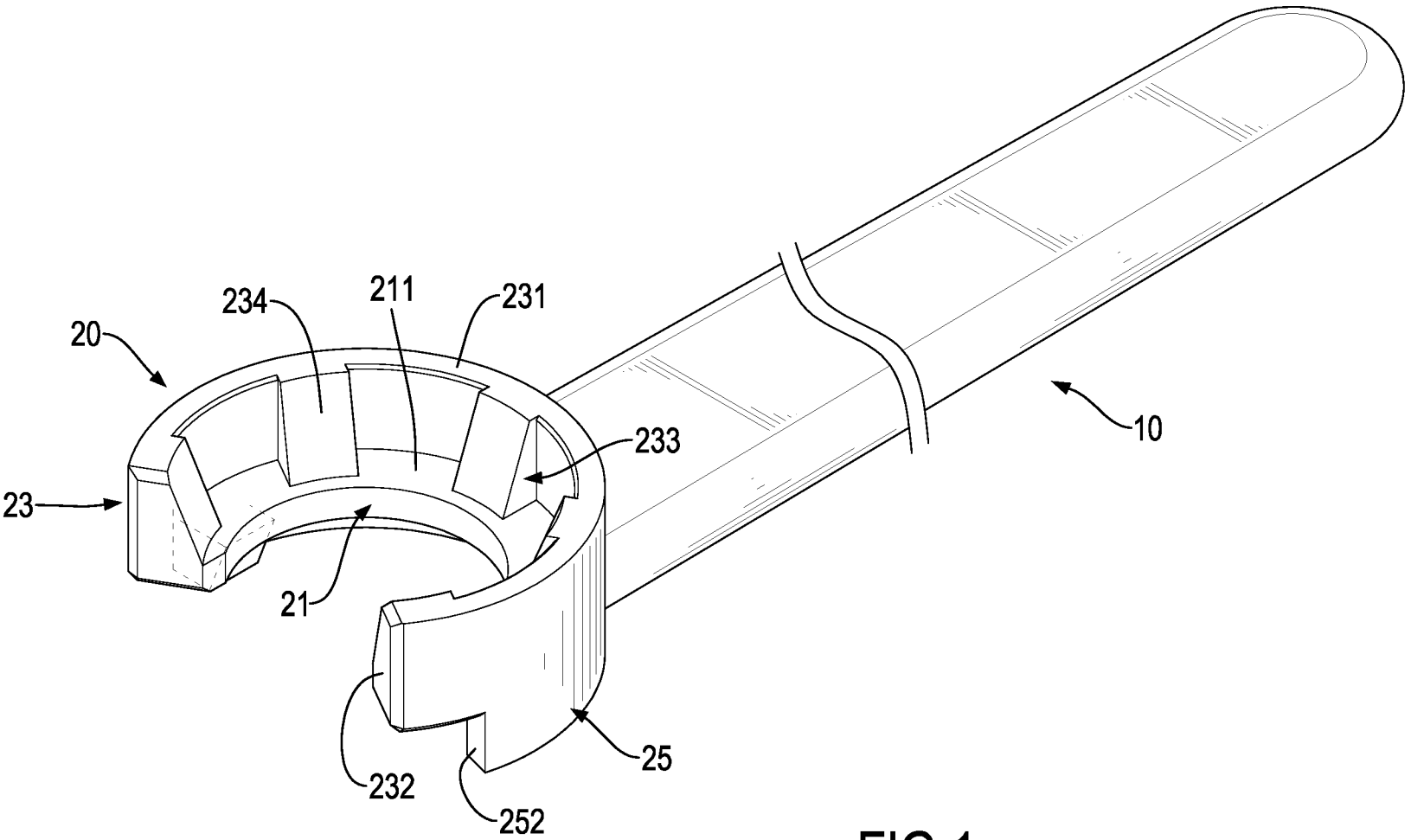
FIG. 1 is a perspective view of a two-way nut spanner in accordance with the present invention.
Figure 2:
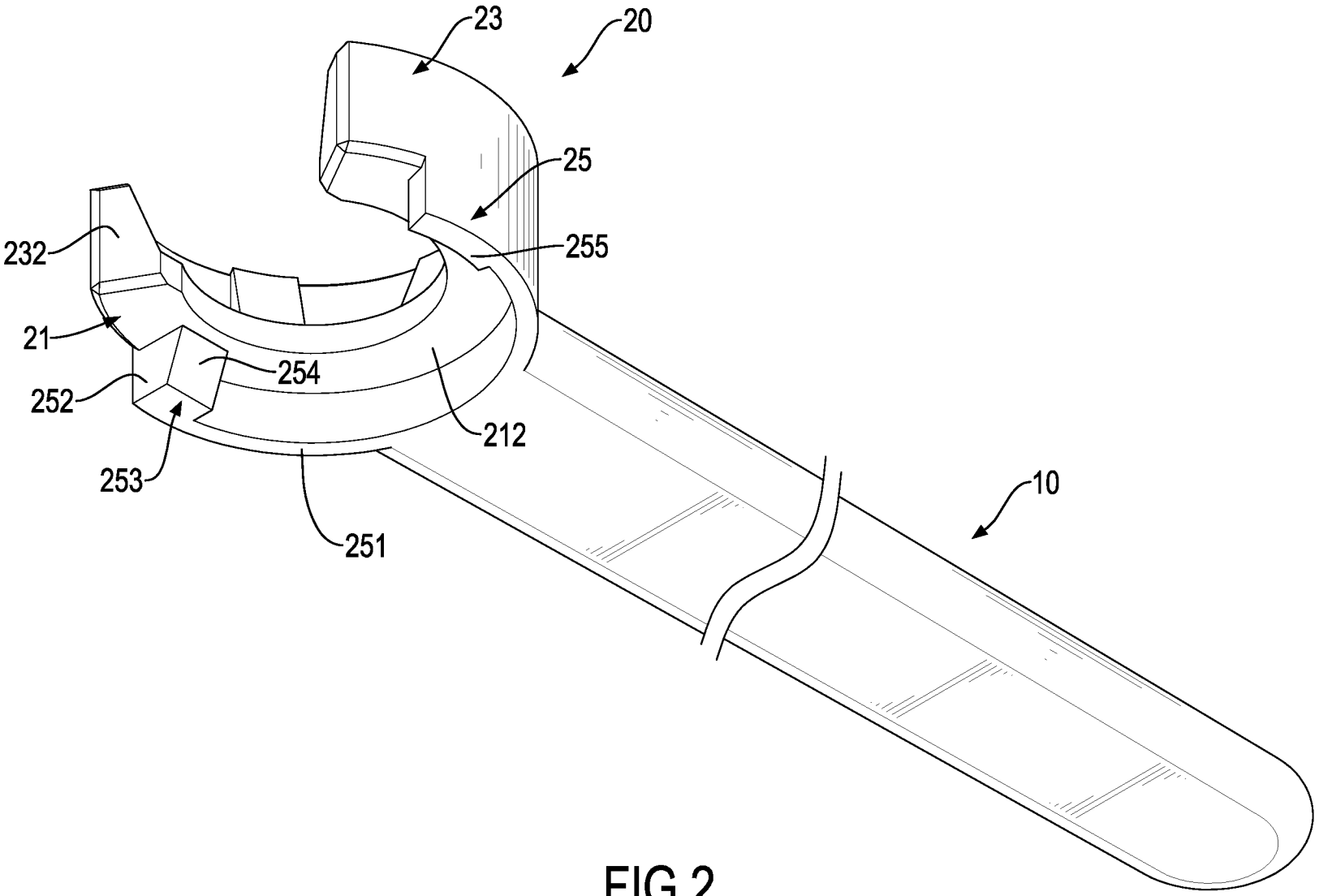
FIG. 2 is another perspective view of the two-way nut spanner in FIG. 1.

With reference to FIGS. 1 to 4, a two-way nut spanner in accordance with the present invention comprises a handle 10 and an engaging head 20 formed on an end of the handle 10.

The engaging head 20 has a central axis A, a base 21, a first engaging portion 23, and a second engaging portion 25. The base 21 surrounds the central axis A of the engaging head 20 to form a C-shape, is formed on the end of the handle 10, and has a first abutting surface 211 and a second abutting surface 212 respectively located at two opposite sides of the base 21. The first engaging portion 23 protrudes from the first abutting surface 211 of the base 21. The second engaging portion 25 protrudes from the second abutting surface 212 of the base 21.

Figure 4:
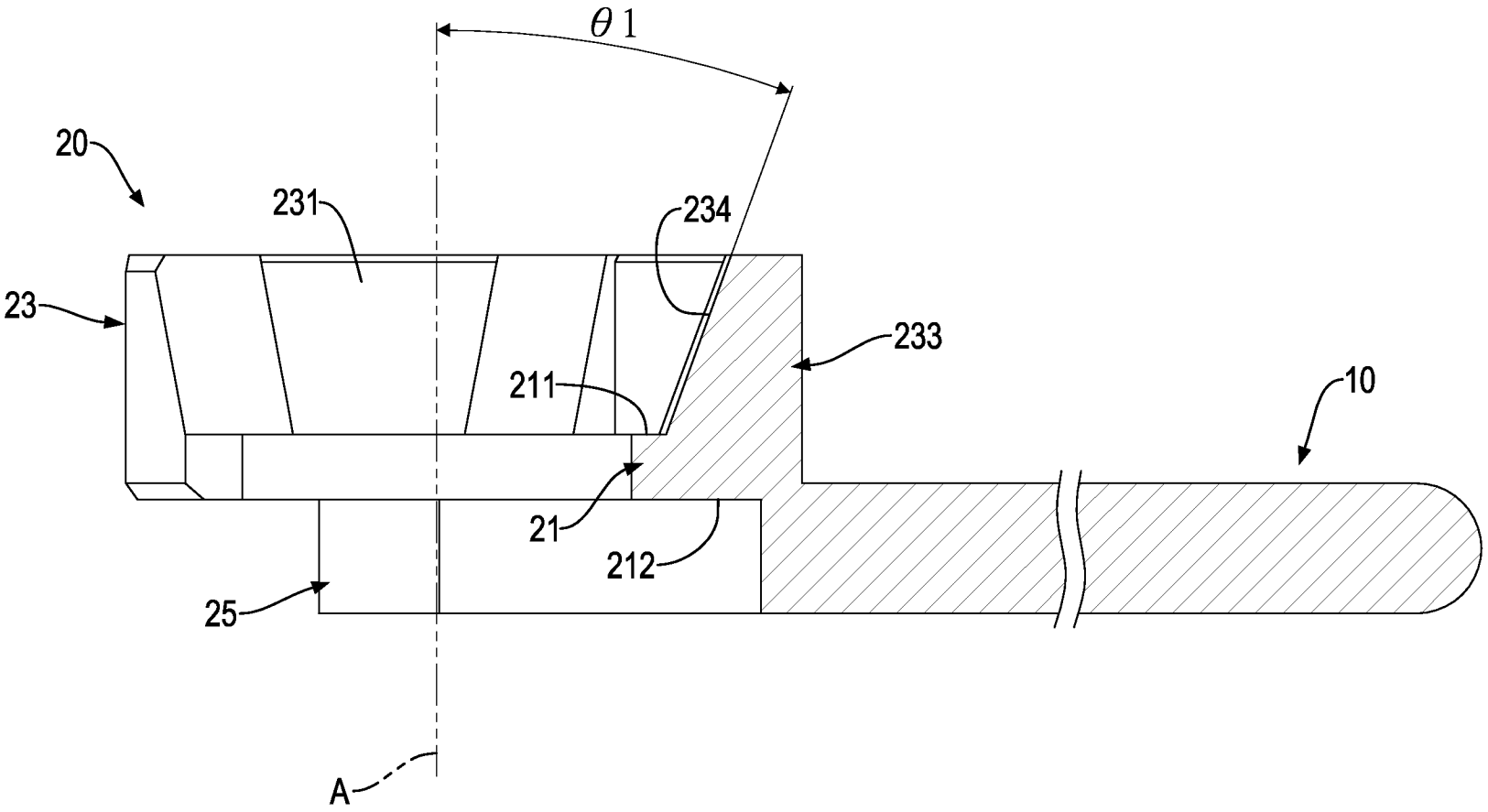
FIG. 4 is an enlarged cross sectional side view of the two-way nut spanner in FIG. 1.
Figure 5:
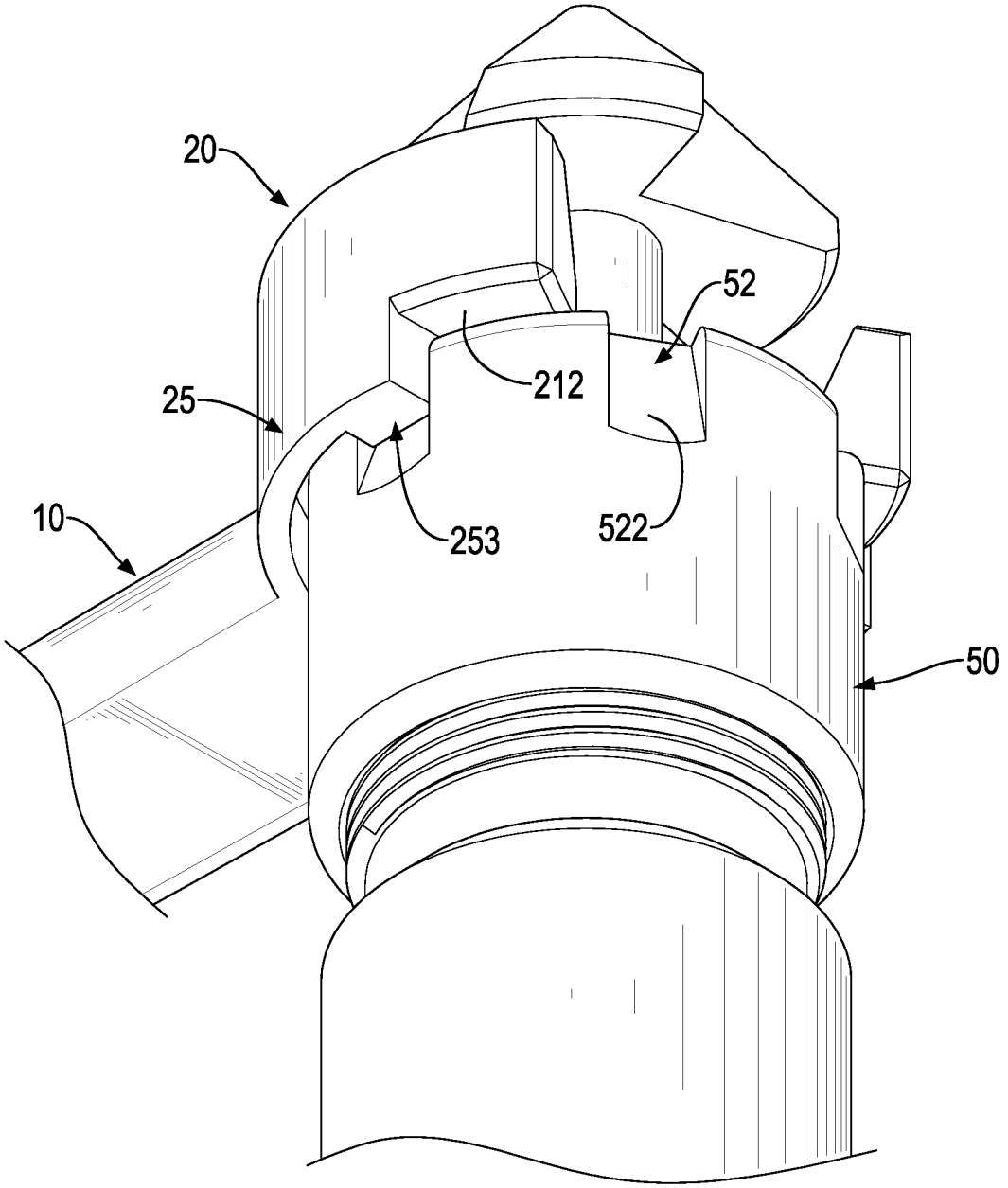
FIG. 5 is an enlarged operational perspective view of the two-way nut spanner in FIG. 1, showing that a second engaging portion is in use.
Figure 6:
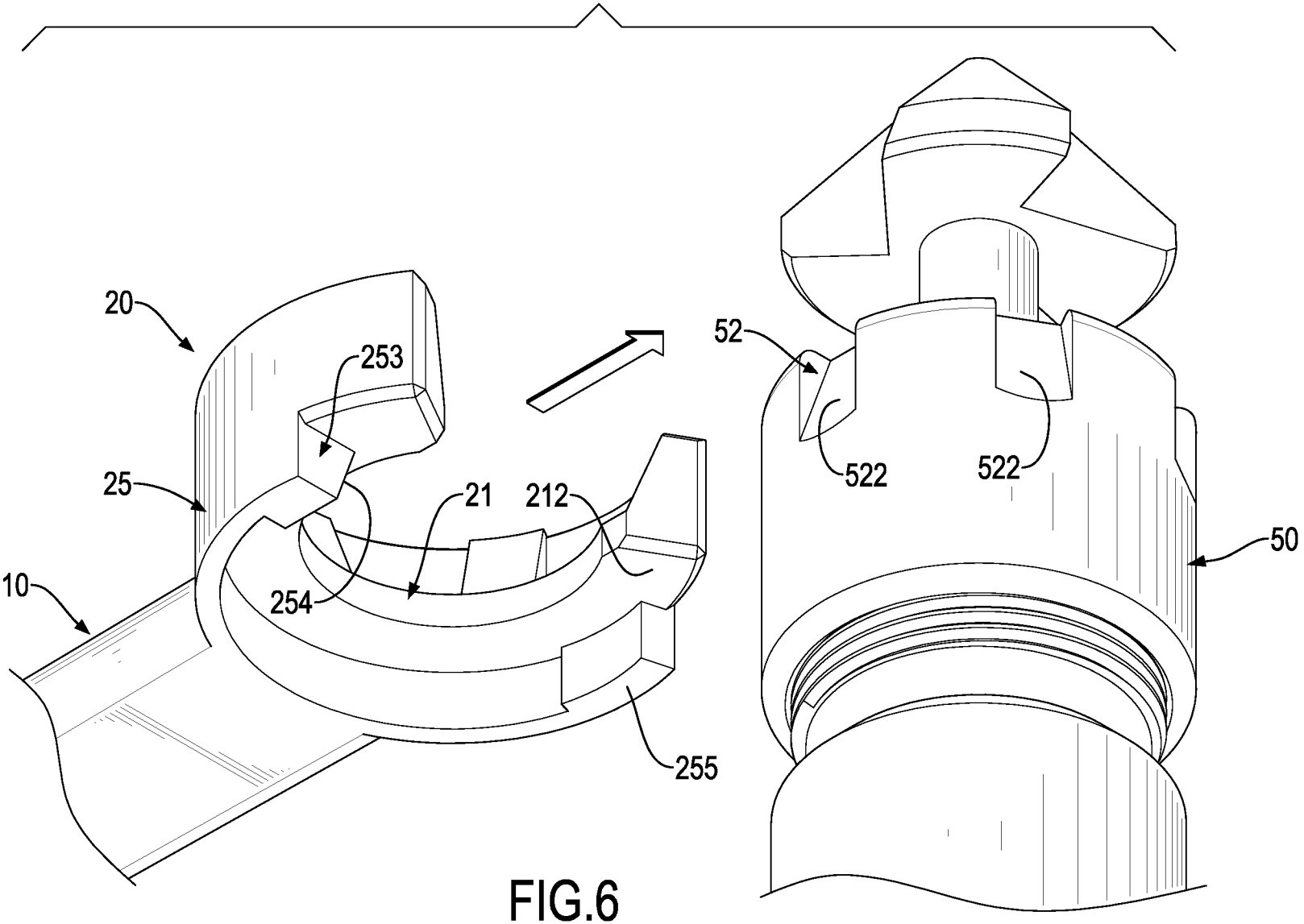
FIG. 6 is an enlarged operational side view of the two-way nut spanner in FIG. 5, showing that the second engaging portion is in use.
Figure 7:
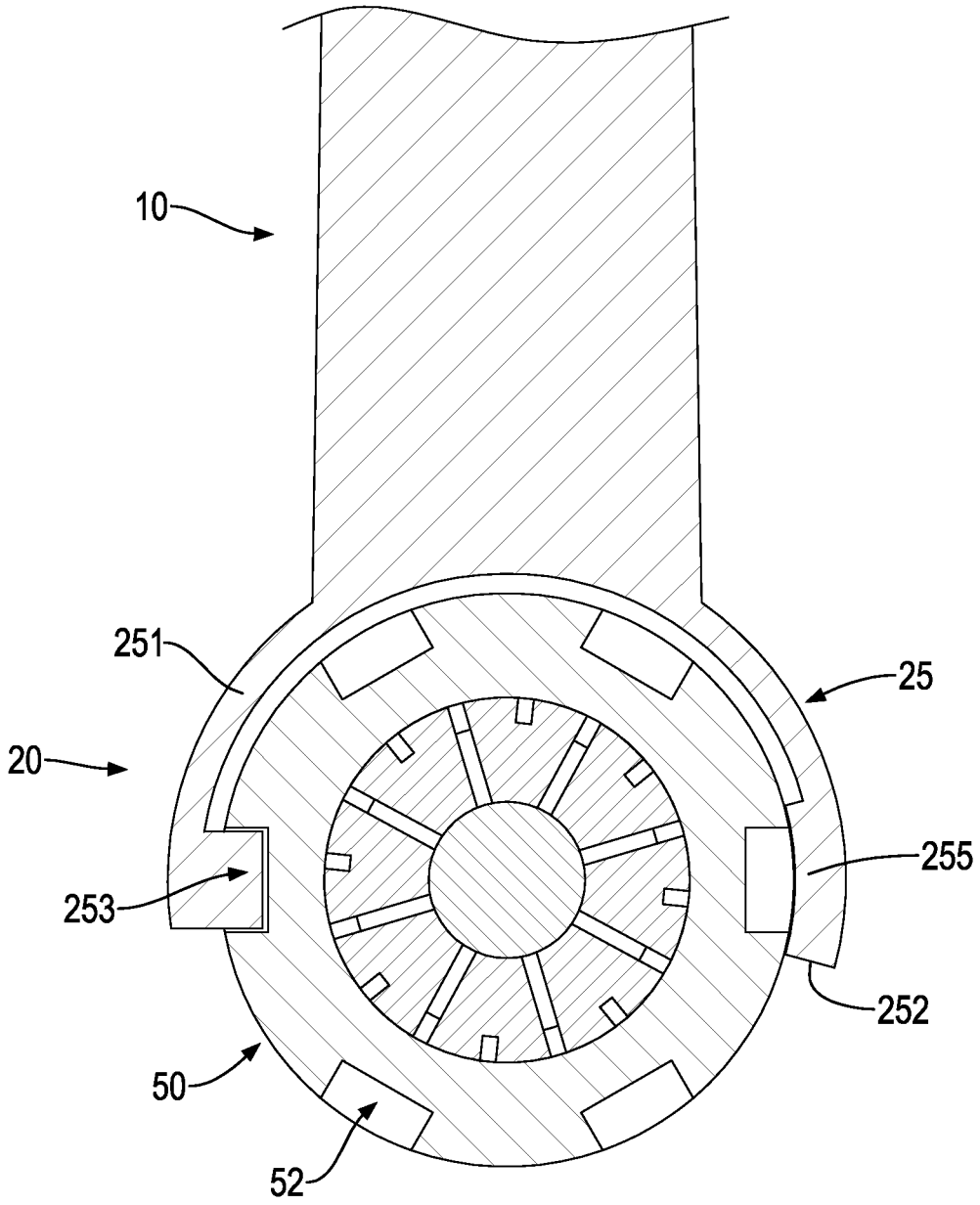
FIG. 7 is an enlarged operational cross sectional top side view of the two-way nut spanner in FIG. 5, showing that the second engaging portion is in use.

The first engaging portion 23 has a first surrounding portion 231 and multiple first engaging blocks 233. The first surrounding portion 231 surrounds the central axis A of the engaging head 20 to form a C-shape, protrudes from the first abutting surface 211, and has a first opening 232. The first surrounding portion 231 has a radian larger than $4\pi/3$ and smaller than $2\pi$. The first engaging blocks 233 protrude from an inner surface of the first surrounding portion 231 and are arranged around the central axis A of the engaging head 20 at angular intervals. Each of the first engaging blocks 233 has a first inclined surface 234 located away from the first surrounding portion 231 and extending obliquely from the first abutting surface 211 of the base 21 toward the first surrounding portion 231 and away from the first abutting surface 211 of the base 21. In this embodiment, the first engaging portion 23 has five first engaging blocks 233 arranged around the central axis A of the engaging head 20 at equiangular intervals. With reference to FIG. 4, an angle θ1 formed between the first inclined surface 234 of each of the first engaging blocks 233 and the central axis A ranges from 20 degrees to 40 degrees, and preferably the angle θ1 is 30 degrees.

With reference to FIGS. 1 to 4, the second engaging portion 25 has a second surrounding portion 251 and a second engaging block 253. The second surrounding portion 251 surrounds the central axis A of the engaging head 20, protrudes from the second abutting surface 212 of the base 21, and has a second opening 252. A width of the second opening 252 of the second surrounding portion 251 is larger than a width of the first opening 232 of the first surrounding portion 231. The second surrounding portion 251 has a radian smaller than 10π/9. An inner diameter of the second surrounding portion 251 is larger than an inner diameter of the first surrounding portion 231.

Figure 3:
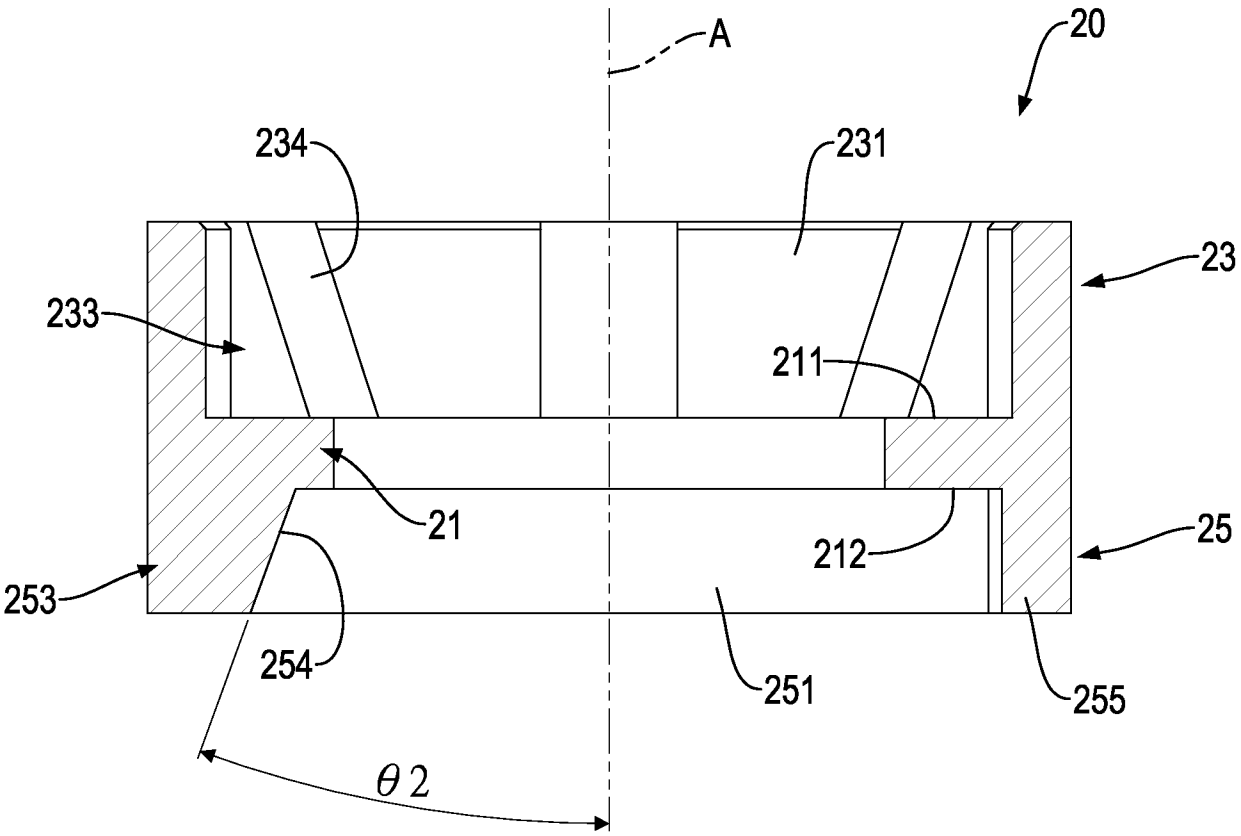
FIG. 3 is an enlarged cross sectional end view of the two-way nut spanner in FIG. 1.

The second engaging block 253 protrudes from an inner surface of the second surrounding portion 251 and is located near one of two edges of the second opening 252. The second engaging block 253 has a second inclined surface 254 located away from the second surrounding portion 251 and extending obliquely from the second abutting surface 212 of the base 21 toward the second surrounding portion 251 and away from the second abutting surface 212 of the base 21. With reference to FIG. 3, an angle θ2 formed between the second inclined surface 254 and the central axis A of the engaging head 20 ranges from 20 degrees to 40 degrees, and preferably the angle θ2 is 30 degrees.

Preferably, the second engaging portion 25 has a supporting block 255 protruding from the inner surface of the second surrounding portion 251 and located near the other one of the two edges of the second opening 252 away from the second engaging block 253.

With reference to FIGS. 5, 6, 9, and 10, the first engaging portion 23 and the second engaging portion 25 of the engaging head 20 are both adapted to detach a nut 50 connected on a cutter holder. The nut 50 has multiple grooves 52 arranged around an external peripheral surface of the nut 50 at angular intervals. Each groove 52 has an inclined groove surface 522 extending obliquely and inwardly from an edge of the groove 52 away from an end surface of the nut 50 to the end surface of the nut 50.

With reference to FIGS. 5 to 8, for use, the second engaging portion 25 is turned to face the nut 50, the second engaging block 253 is inserted into one of the grooves 52 of the nut 50, the supporting block 255 abuts against the external peripheral surface of the nut 50, and the second abutting surface 212 of the base 21 abuts on the end of the nut 50. After that, force is applied to the handle 10 to turn the nut 50 rotating relative to the cutter holder to detach or fasten the nut 50.

Because the second engaging portion 25 has one single second engaging block 253, if a cutter having a large cutting head, such as a chamfer cutter, is connected on the cutter holder, the second engaging portion 25 can be laterally moved close to the nut 50, and then the second engaging block 253 is inserted and engaged in one of the grooves 52 of the nut 50. Thus, the convenience for using the second engaging portion 25 to turn the nut 50 can be enhanced. Because the second block 235 has the second inclined surface 254 and the second engaging block 253 corresponding in size and shape to each of the grooves 52 of the nut 50, the second engaging block 253 can be deeply inserted in one of the grooves 52 to increase an engaging area between the second engaging block 253 and the corresponding groove 52 and to increase engaging strength.

Figure 8:
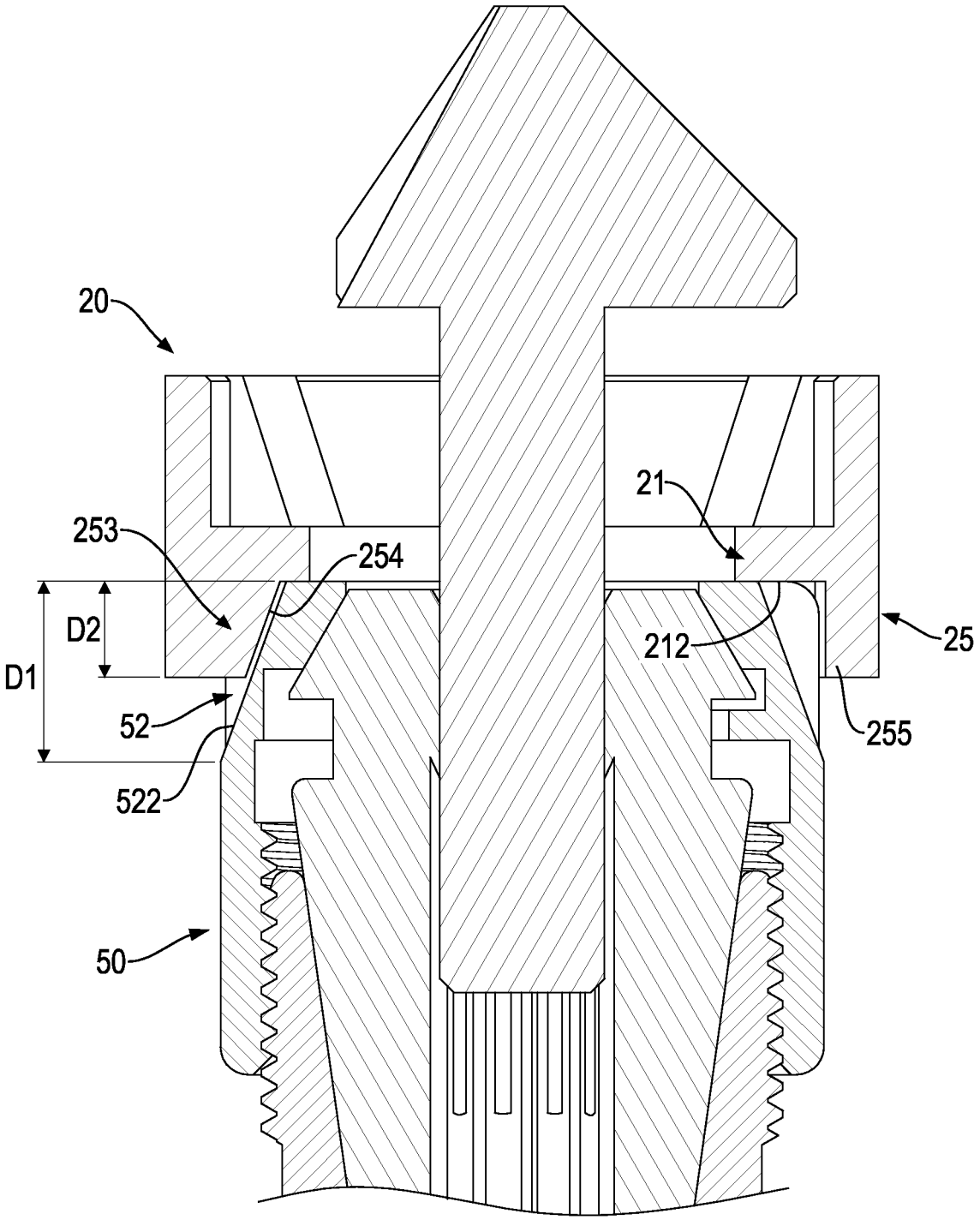
FIG. 8 is an enlarged operational cross sectional end view of the two-way nut spanner in FIG. 5, showing that the second engaging portion is in use.
Figure 9:
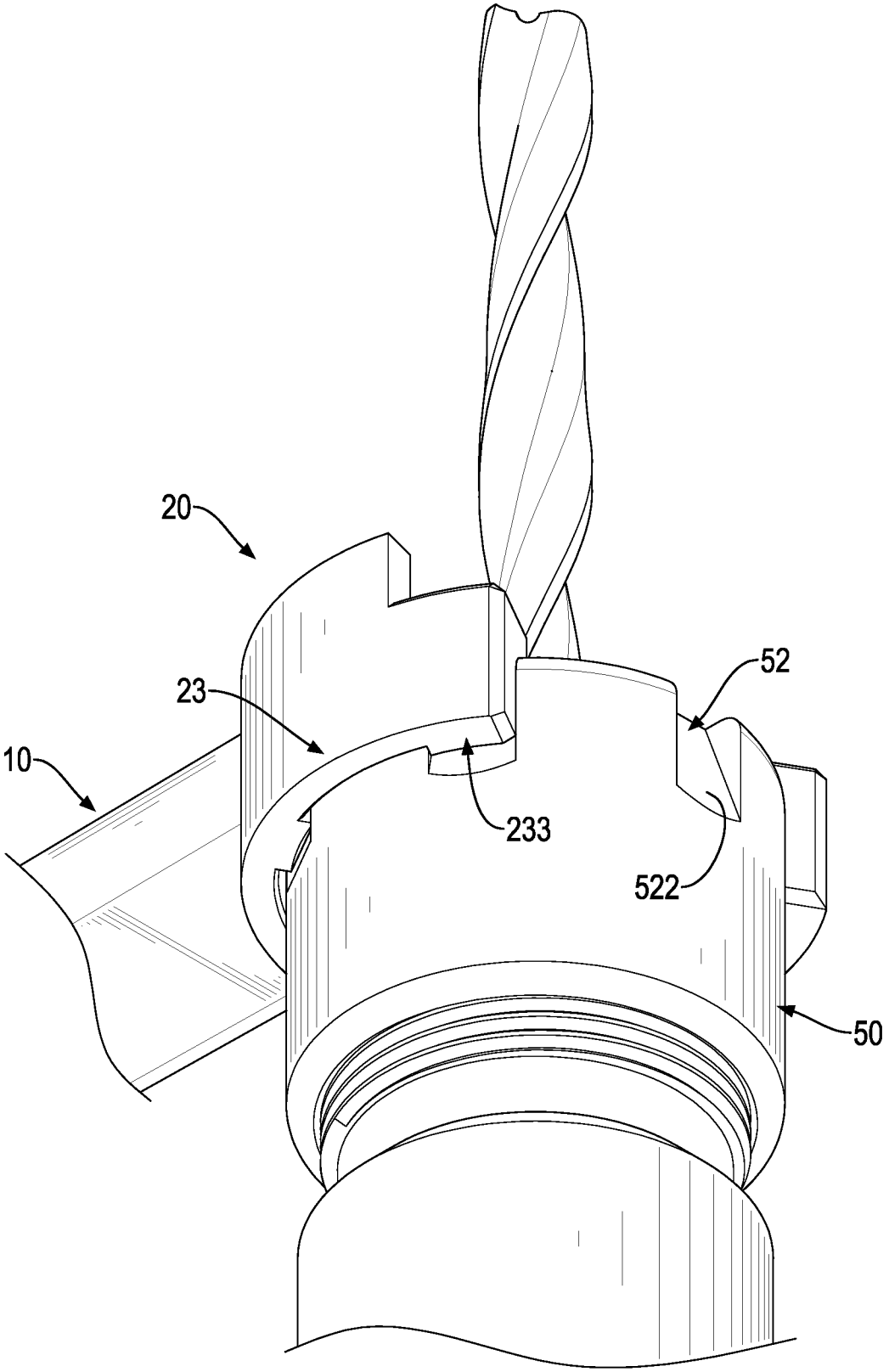
FIG. 9 is an enlarged operational perspective view of the two-way nut spanner in FIG. 1, showing that a first engaging portion is in use.
Figure 10:
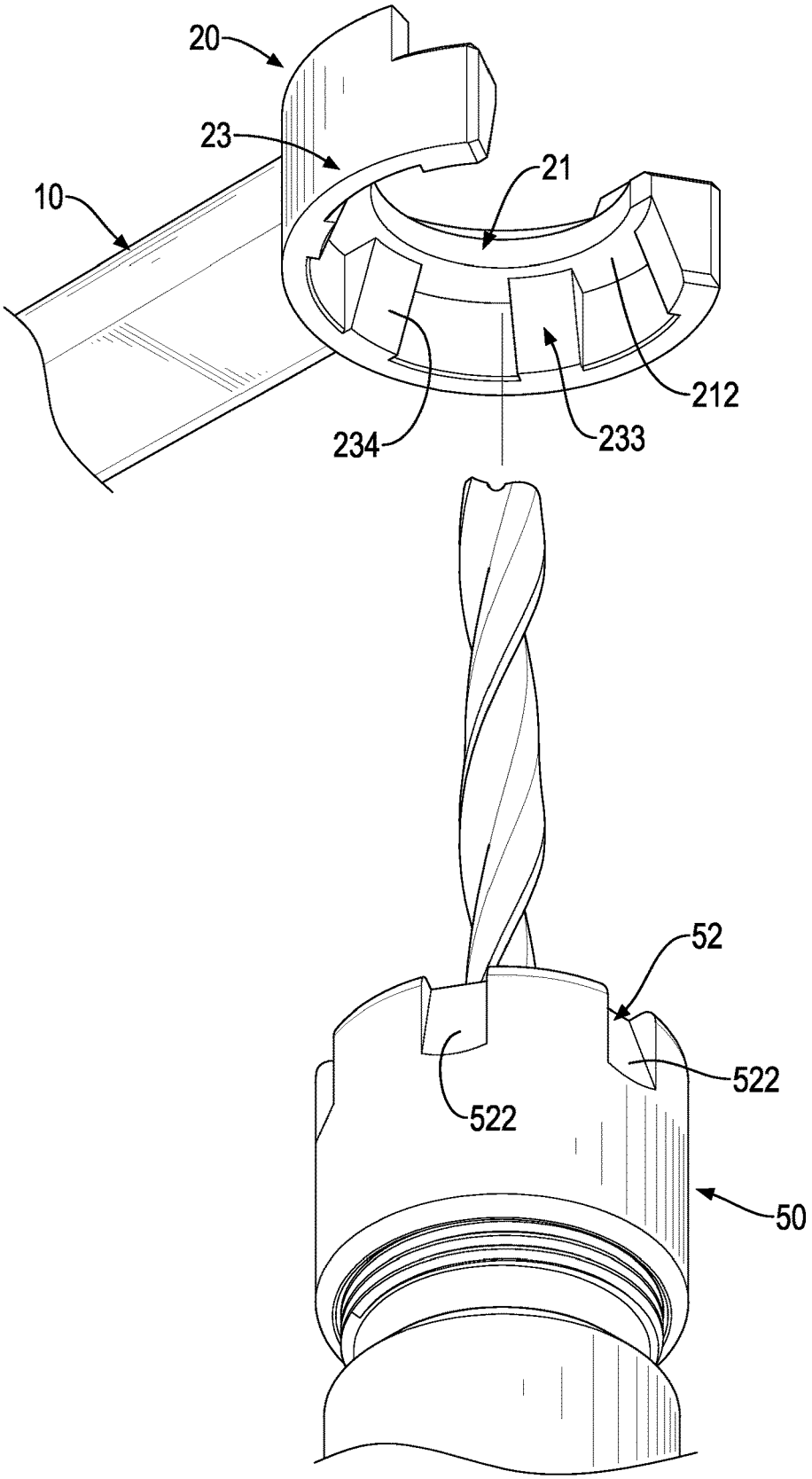
FIG. 10 is an operational side view of the two-way nut spanner in FIG. 9, showing that the first engaging portion is in use.
Figure 11:
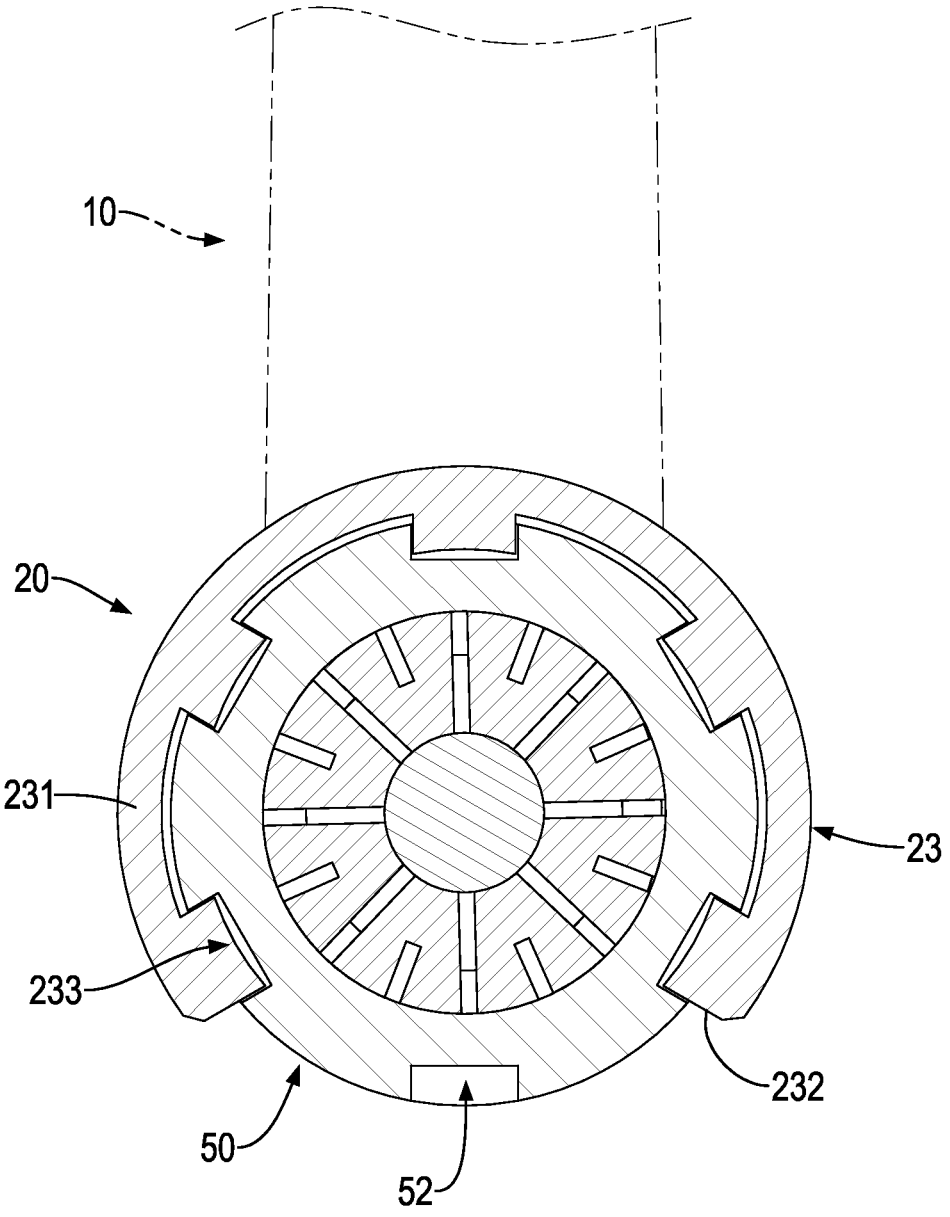
FIG. 11 is an enlarged operational cross sectional top side view of the two-way nut spanner in FIG. 9, showing that the first engaging portion is in use.

Preferably, with reference to FIG. 8, a vertical distance D2 from an end of the second engaging block 253 to the second abutting surface 212 of the base 21 is larger than or equal to 0.5 times of a vertical length D1 of each of the grooves 52 of the nut 50 to avoid that a length of the second engaging block 253 inserted in the groove 52 is too small, such that the second engaging block 253 can be stably engaged with the groove 52.

With reference to FIGS. 9 to 12, to use the first engaging portion 23, the first engaging portion 23 is turned to face the nut 50, and is moved vertically to connect the first engaging portion 23 with the nut 50, wherein the multiple first engaging blocks 233 are respectively inserted in some of the grooves 52 of the nut 50, and the first abutting surface 211 of the base 21 abuts against the end surface of the nut 50. After that, a user applies force to the handle 10 to turn the nut 50 rotating relative to the cutter holder to fasten or detach the nut 50.

The first engaging portion 23 has multiple first engaging blocks 233. When connected with a cutter having a small cutting head, such as a drill, the engaging head 20 can be directly and vertically putted on and connect with the nut 50. The multiple first engaging blocks 233 are inserted in and engage with the grooves 52 of the nut 50 respectively to increase engaging strength. So a user can easily apply force to the handle 10 to turn the nut 50. Because each of the first engaging blocks 233 has the first inclined surface 234 and each of the first engaging blocks 233 corresponds in size and shape to each of the grooves 52 of the nut 50, each of the first engaging blocks 233 can be deeply inserted in a corresponding one of the grooves 52 to increase an engaging area between each of the first engaging blocks 233 and the corresponding one of the grooves 52 and to increase engaging strength.

Figure 12:
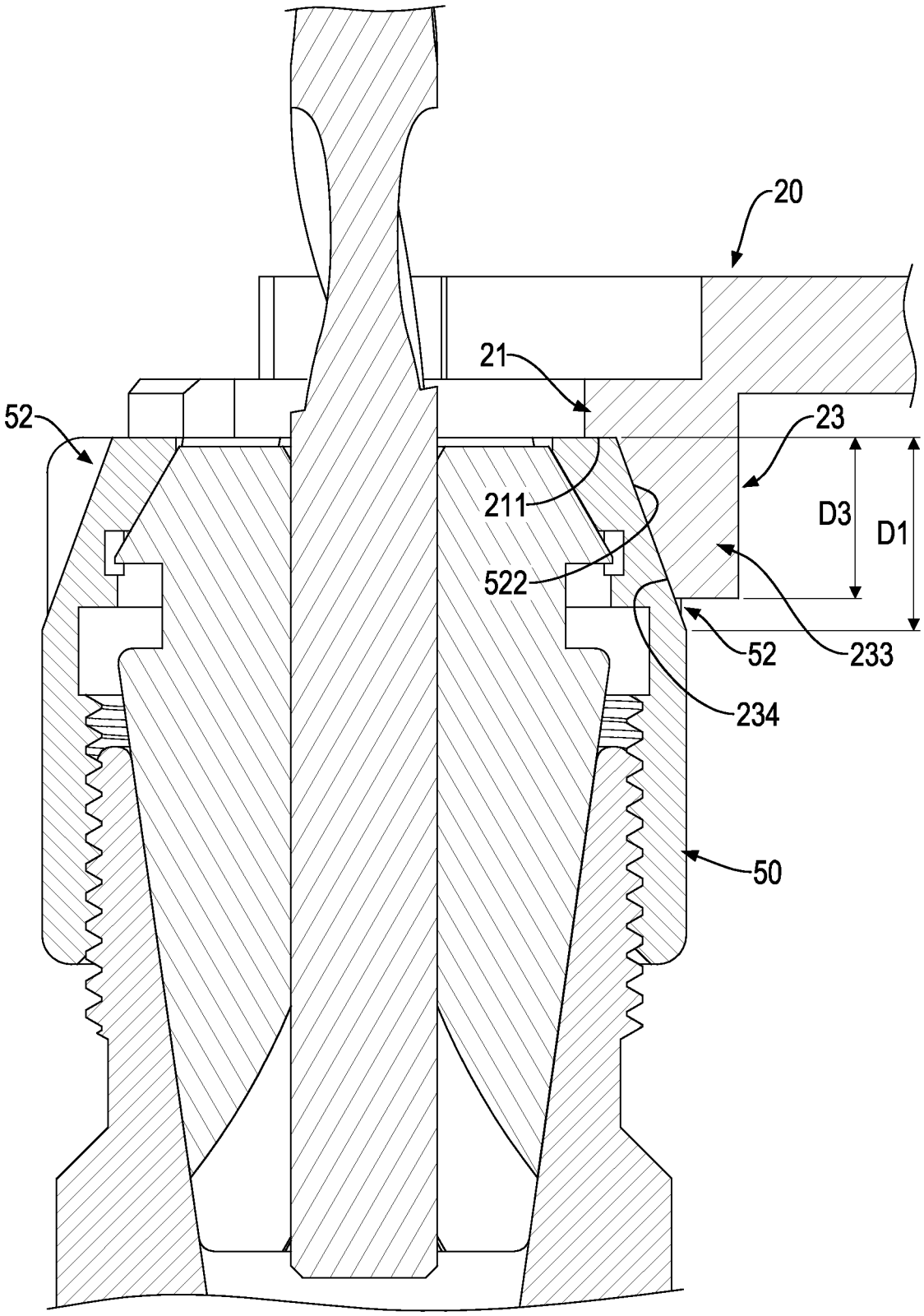
FIG. 12 is an enlarged operational cross sectional side view of the two-way nut spanner in FIG. 9, showing that the first engaging portion is in use.

Preferably, with reference to FIG. 12, a vertical distance D3 from an end of each of the first engaging blocks 233 to the first abutting surface 211 of the base 21 is larger than or equal to 0.5 times of a vertical length D1 of each of the grooves 52 of the nut 50. In this embodiment, the vertical distance D3 from the end of each of the first engaging blocks 233 to the first abutting surface 211 of the base 21 is larger than or equal to ⅔ times of a vertical length D1 of each of the grooves 52 of the nut 50 to increase the length of each of the first engaging blocks 233 engaged in the corresponding one of the grooves 52.

Preferably, the inner diameter of the first surrounding portion 231 is 0.1 millimeters to 0.3 millimeters and is larger than an external diameter of the nut 50. For example, if the external diameter of the nut 50 is 20 millimeters, the inner diameter of the first surrounding portion 231 is around 20.1 millimeters to 20.3 millimeters to reduce a gap formed between the first surrounding portion 231 and the nut 50. The first engaging portion 23 can tightly surround the nut 50.

Preferably, a width of each of the first engaging blocks 233, which is a horizontal distance between two opposite edges, is 0.1 millimeters to 0.15 millimeters and is smaller than a width of each of the grooves 52 of the nuts 50 to reduce a gap formed between each of the first engaging blocks 233 and the corresponding one of the grooves 52 of the nut 50.

With such arrangement, the two-way nut spanner in accordance with the present invention has advantages as follows:

1. Because the engaging head 20 has the first engaging portion 23 and the second engaging portion 25 with different engaging structures, a user can select one of the first engaging portion 23 and the second engaging portion 25 to detach or fasten the nut 50 according to which type of cutter is connected on the cutter holder. The convenience for using the two-way nut spanner is enhanced.

2. The first engaging blocks 233 and the second engaging block 253 correspond in shape and size to the grooves 52 of the nut 50 to deeply engage with the grooves 52 of the nut 50. The engaging stability and engaging strength of each of the first engaging blocks 233 and the second engaging block 253 engaged with each of the grooves 52 of the nut 50 can be enhanced.

What is claimed is:

1. A two-way nut spanner comprising:

a handle; and an engaging head formed on an end of the handle and having a central axis;

a base surrounding the central axis of the engaging head to form a C-shape and having a first abutting surface and a second abutting surface respectively located at two opposite sides of the base;

a first engaging portion protruding from the first abutting surface of the base and having a first surrounding portion being C-shaped, protruding from the first abutting surface of the base, and having a first opening; and multiple first engaging blocks protruding from an inner surface of the first surrounding portion, and arranged around the central axis of the engaging head at angular intervals, each of the first engaging blocks having a first inclined surface located away from the first surrounding portion and extending obliquely from the first abutting surface of the base toward the first surrounding portion and away from the first abutting surface of the base; and a second engaging portion protruding from the second abutting surface of the base and having a second surrounding portion being C-shaped, protruding from the second abutting surface, and having a second opening; and a second engaging block protruding from an inner surface of the second surrounding portion, located near one of two edges of the second opening, and having a second inclined surface located away from the second surrounding portion and extending obliquely from the second abutting surface toward the second surrounding portion and away from the base;

wherein a width of the second opening of the second surrounding portion is larger than a width of the first opening of the first surrounding portion.

2. The two-way nut spanner as claimed in claim 1, wherein the second engaging portion has a supporting block protruding from the inner surface of the second surrounding portion and located near the other one of the two edges of the second opening away from the second engaging block.

3. The two-way nut spanner as claimed in claim 2, wherein an angle formed between the first inclined surface of each of the first engaging blocks and the central axis ranges from 20 degrees to 40 degrees, and an angle formed between the second inclined surface of the second engaging block and the central axis ranges from 20 degrees to 40 degrees.

4. The two-way nut spanner as claimed in claim 3, wherein the first engaging portion has five said first engaging blocks arranged around the central axis of the engaging head at equiangular intervals.

5. The two-way nut spanner as claimed in claim 2, wherein the first surrounding portion has a radian larger than $4\pi/3$ and smaller than $2\pi$, and the second surrounding portion has a radian smaller than $10\pi/9$.

6. The two-way nut spanner as claimed in claim 5, wherein the first engaging portion has five said first engaging blocks arranged around the central axis of the engaging head at equiangular intervals.

7. The two-way nut spanner as claimed in claim 2, wherein an inner diameter of the second surrounding portion is larger than an inner diameter of the first surrounding portion.

8. The two-way nut spanner as claimed in claim 7, wherein the first engaging portion has five said first engaging blocks arranged around the central axis of the engaging head at equiangular intervals.

9. The two-way nut spanner as claimed in claim 2, wherein the first engaging portion has five said first engaging blocks arranged around the central axis of the engaging head at equiangular intervals.

10. The two-way nut spanner as claimed in claim 1, wherein the first engaging portion has five said first engaging blocks arranged around the central axis of the engaging head at equiangular intervals.

* * * * *